United States Patent [19]

Moss et al.

[11] Patent Number: 4,678,309

[45] Date of Patent: Jul. 7, 1987

[54] DEVICE FOR PROCESSING A ROLE OF EXPOSED FILM COILED ON A SPOOL

[75] Inventors: Brian F. Moss, Chelford; Richard J. Brent, Handforth, both of England

[73] Assignee: Ciba-Geigy AG, Basel, Switzerland

[21] Appl. No.: 832,939

[22] Filed: Feb. 26, 1986

[30] Foreign Application Priority Data

Mar. 7, 1985 [GB] United Kingdom ..... 85 05896
Jun. 25, 1985 [GB] United Kingdom ..... 85 16056

[51] Int. Cl.[4] ..... G03D 13/06

[52] U.S. Cl. ..... 354/313; 354/323; 354/329; 354/337

[58] Field of Search ..... 354/310, 311, 312, 313, 354/314, 316, 323, 329, 330, 337, 335

[56] References Cited

U.S. PATENT DOCUMENTS 2,959,115 11/1960 McClernon ..... 354/329
4,001,857 1/1977 Ikechi et al. ..... 354/323
4,134,666 1/1979 Kikuchi ..... 354/313
4,290,687 9/1981 Takahashi ..... 354/330
4,291,968 9/1981 Work ..... 354/313
4,586,803 5/1986 Moss et al. ..... 354/323

*Primary Examiner*—A. A. Mathews
*Attorney, Agent, or Firm*—Harry Falber

[57] ABSTRACT

There is described a device for processing a roll of exposed film coiled on a spool which comprises a cylindrical light-tight container wherein the film on the spool is rotated and which is of sufficient diameter and height to accommodate the film loosely coiled on the spool, a light-tight lid to close the container, the device being characterized in that it comprises at least two radially extending raised members attached to the base of the container so shaped that as the wound film is rotated in the container some of the convolutions of the film are at one instance bunched together, while other convolutions are separated and means connectable to the spool for enabling the spool to be rotated when it is in the container.

17 Claims, 10 Drawing Figures

DEVICE FOR PROCESSING A ROLE OF EXPOSED FILM COILED ON A SPOOL

This invention relates to a processing device for exposed lengths of photographic film.

Most photographic films which are home processed or processed commercially in a small way are processed in a so-called spiral developing tank. To use such a tank the film is removed from the cassette and after trimming its leading edge, this leading edge is inserted into the mouth of a spiral. The film is then worked into the spiral so that the whole length of film is held helically wound in the spiral. The spiral is placed in a light-tight container to which processing liquid can be added. All this must be carried out in complete darkness to avoid fogging the film. However, once the spiral holding the film has been placed in the light-tight container the various processing liquids can be poured in and removed from the container in daylight.

This is a well tried method but nevertheless photographers who are keen to process their own film find the threading of the spiral in the dark difficult to carry out satisfactorily. Often the film turns overlap as the film slips out of the guiding system. This causes uneven processing and frames are often ruined as a result.

It is impossible to check if the film has been correctly wound into the spiral because of the light-less conditions. Thus the realisation of the difficulties of loading a spiral in the dark has dissuaded numbers of potential home processors from attempting to process their own films.

It is the object of the present invention to provide a processing device for exposed lengths of film which does not use a spiral but by means of which films can be very efficiently processed.

According to the present invention there is provided a device for processing a roll of exposed film coiled on a spool which comprises a cylindrical light-tight container wherein the film on the spool is rotated and which is of sufficient diameter and height to accommodate the film loosely coiled on the spool, a light-tight lid to close the container the device being characterised in that it comprises at least two radially extending raised members attached to the base of the container so shaped that as the wound film is rotated in the container some of the convolutions of the film are at one instance bunched together whilst other convolutions are separated and means connectable to the spool for enabling the spool to be rotated when it is in the container.

When using the device to process a length of exposed film wound on a spool as the coiled film on the spool is rotated some of its convolutions are bunched together whilst others are separated at any one instance. This complex action of bunching and separating the convolutions of film as the coiled film is rotated in the liquid in the container continuously draws liquid between the coils of film and then expells it. Thus in effect a pumping action is achieved; fresh liquid, either processing solution or wash water, being applied continuously to the emulsion surface of the film.

Various configurations of the profile of the raised members may be used to cause the bunching or separating action on the coiled film as it is rotated In one embodiment of the device of the present invention the container comprises at least one radially extending raised member attached to its base so shaped that convolutions of the wound film being passed over it are caused to be bunched together and at least one radially extending raised member attached to its base so shaped that the convolutions of the wound film being passed over it are caused to be separated.

Usefully the radially extending raised member which is shaped to bunch together the convolutions of the wound film is concave.

Usefully the radially extending raised member which is shaped to separate the convolutions of the wound film slopes away from the centre to the side of the container.

Preferably the raised members are opposed radially to enable the end of spool in which the film is coiled to be accommodated between them.

In this embodiment of the device of the present invention as the coiled film on the spool is rotated the convolutions are bunched together by the raised concave member and then separated by the raised member which slopes away from the centre. Thus during the rotation of the wound film in the container the convolutions in any one segment of the wound film are bunched together and then drawn apart. Thus as a segment of the wound film is passed over the concave member processing solution is expelled from between the film convolutions and as the same segment of the wound film is passed over the raised member which slopes away solution is drawn up between the convolutions. Thus in effect a pumping action is achieved, fresh solution continuously being applied to the emulsion surface of the film being processed.

In another embodiment of the device of the present invention the container comprises at least one radially extending raised member attached to its base so shaped that those convolutions of a coiled film being passed over the member which are nearest to the spool are caused to be bunched together and those convolutions which are more remote from the spool are caused to be separated from each other and at least one radially extending raised member attached to its base so shaped that those convolutions of a coiled film being passed over the member which are nearest to the spool are caused to be separated and those convolutions which are more remote from the spool are caused to be bunched together. Preferably there are only two raised members.

Usefully the radially extending raised member which is shaped to bunch together those convolutions close to the spool and to separate those convolutions more remote from the spool comprises a step over which the film convolutions have to ride as the spool having the film wound thereon rotates and which member slopes away from the highest point of the step towards the inside wall of the container.

Usefully the radially extending raised member which is shaped to separate those convolutions which are nearest the spool and to bunch together those convolutions more remote from the spool is so formed that it initally slopes away from the spool to the inside wall of the container as it nears the inside wall of the container it is curved sharply upward.

Preferably both these raised members have at their end closest to the inside wall of the container a vertical end stop of sufficient height to prevent the leading edge of the film as it is rotated on the spool from pressing against the inside wall of the container.

In one embodiment there is present on the base of the container a third vertical stop member not attached to a raised member.

In yet another embodiment of the device of the present invention the container comprises on its base three raised members each of which comprises a step and each of which slopes away from the highest point of the step towards the inside wall of the container, the step on each of these members being located at a different radial distance from the centre of the container.

This embodiment of the device is so designed to enable film strips of different lengths to be processed with equal efficiency. The more usual lengths of film strips are those which comprises 12, 20 and 36 exposed frames.

In this embodiment of the device the raised member whose step is closest to the centre of the container serves primarily to separate the convolutions, one or both of the other members serving primarily to bunch the convolutions depending on the length of the film strip. However the behaviour pattern of bunching of the convolutions and separating of the convolutions in this embodiment is complex and all three raised members serve to some extent to both bunch and separate the convolutions of the wound film on the coil.

Preferably in this embodiment of the device of the present invention the coiled film is rotated clockwise in the container to cause the convolutions to bunch and separate. When the film is rotated anticlockwise the shape of the raised members causes the coils of film to bunch together towards the inner wall of the container. This has the effect of expelling all the liquid from between the coils of wound film.

In all the embodiments of the device as just described by base of the container is meant either the floor of the container on which the film being processed rests, or preferably the raised members are attached to a false base of the container which acts as a light shielding member over the floor of the container which contains holes through which liquid can enter the container and leave the container.

Preferably when using the device of the present invention the film on the spool is continuously rotated during the whole processing step. This rotation may be carried out manually or an external means to rotate the rotating means connected to the spool may be employed. Sometimes the rotation is clockwise so that the unsecured leading edge of the film trails when the film on the spool is rotated. However most preferably the rotation is first anticlockwise and then after a predetermined number of rotations in this direction a similar number or a greater number of rotations are performed in a clockwise direction followed by anticlockwise and then clockwise rotation until the predetermined residence time of the film in the processing liquid or wash water has elapsed. When the rotation is in two directions this rotation is conveniently achieved by useof an automatic means which alters its direction of rotation after a predetermined time.

In conventional processing devices uniform processing is achieved by causing movement of the film bodily through the processing solution or agitation of the solution by invertion of the device in a spiral processor so that fresh processing solution is continually brought into contact with the emulsion layer of the film and the exhausted solution is washed off the surface. In the device of the present invention this requirement is met in a novel way in that the expanding and contracting film roll is used to create a pumping motion, thus providing a compact (i.e. low volume) and convenient processing device which nevertheless provides high quality results.

Processing liquid may be provided in the container by placing the liquid in the container before the coiled film is placed therein or by introducing it therein afterwards. This may be accomplished by pouring it through a specially constructed lid, by introducing it through a specially constructed base of the container or via a pipe above the liquid level which is formed in the side wall of the container.

The device of the present invention may be a simple container which is not significantly greater in height than the length of the spool on which the film is coiled or it may be part of a much bigger device in which provision is made to receive a cassette loaded with exposed film, the receiving area being located directly above the container in which the processing is carried out. In this case means are provided for forcing the film on the spool out of the cassette and into the liquid container part of the device. Preferably the film is forced out of the container by use of a plunger fitted to the lid of the device.

Most preferably in this case the end of the plunger is so designed that it readily engages the end of the spool in the cassette and subsequently retains it by virtue of an interference fit achieved by slight compression of the plunger tip.

Thus when the lower-most end cap of the cassette is forced off the plunger the spool is still retained on the plunger as the plunger forces the spool with coiled film into the liquid container. The plunger when fully extended in the device can be rotated.

When the device of the present invention is a simple container preferably there is present in the lid, placed in the centre thereof a rotatable shaft to which the end of the spool can be engaged in an interference fit and which comprises externally means to rotate the shaft.

Automatic means may be connected to the external end of the plunger or shaft, that is to say the end of the plunger or shaft to which the spool is not attached, to cause the plunger or shaft to rotate first in one direction and then in the other direction until the processing step is complete.

The accompanying drawings will serve to illustrate the invention.

The same parts of the cassette of FIG. 1 retain the same designations in all the figures.

In FIGS. 2–4 the same numbers have the same signification.

Figure 1:
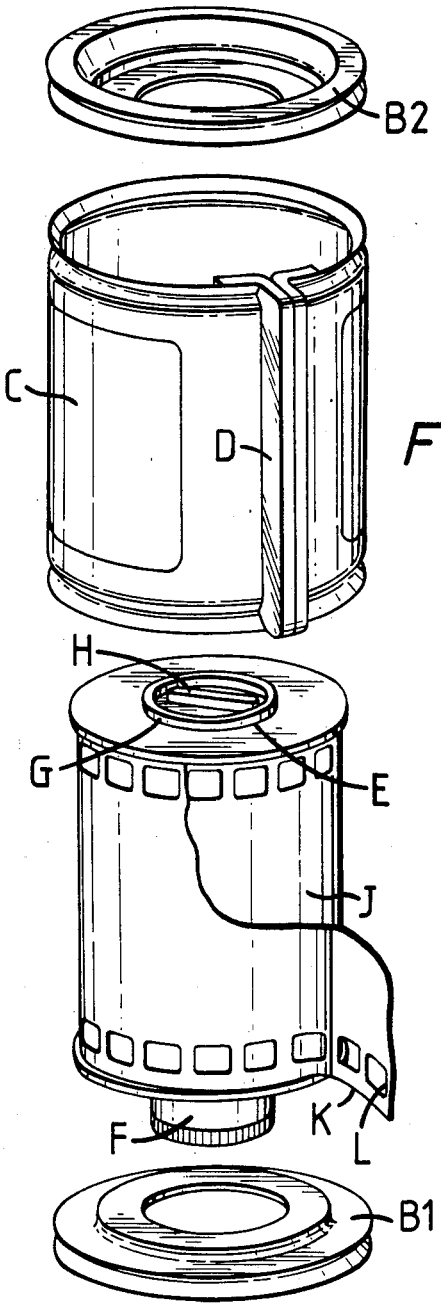
FIG. 1 is an exploded view of a 35mm film cassette loaded with a length of film.

In FIG. 1 is shown a normal 35 mm film cassette which comprises two end caps B1 and B2 and a cassette body C and a film exit slot D which is formed by pinching together the two ends of the metal strip which form the cassette body C. When assembled there is present in the cassette body a spool E which has a long hub end F and a short hub end G. Located inwards of end G is an axial member H by use of which in a camera the film is wound either onto the spool past the exposure chamber. The film is shown as J. The leading edge of the film is shown as K and the sprocket holes as L.

In FIGS. 2–5 the apparatus comprises a lid 1 which is connected by screw means 2 to a columnar body 3. Attached to the lid 1 is a plunger 5. Present in the columnar body 3 towards its open end is a block 6. Below the block 6 is a space 8 into which processing liquid can be introduced. Attached to the bottom of the columnar body 3 by screw means is a removable base 9 which has over it a false base 10 which comprises a labyrinth means for enabling processing solution to enter therein without the ingress of light. Columnar body 3 has been inserted into a wide bottomed processing bath 11.

The sides of the bath 11 fit closely around the columnar body 3.

Present attached to the sides of the columnar body 3 and located below the block 6 and above the space 8 is a truncated cone shelf 12 which has in its centre a circular hole 13.

As shown in the Figures the top of the cone shelf 12 has been formed at an angle.

Members 14 and 15 are raised members. The shape of the raised members 14 to 15 are different in FIGS. 2–4 to those in FIG. 5. The next part of the description relates specifically to the device shown in FIGS. 2–4.

Figure 2:
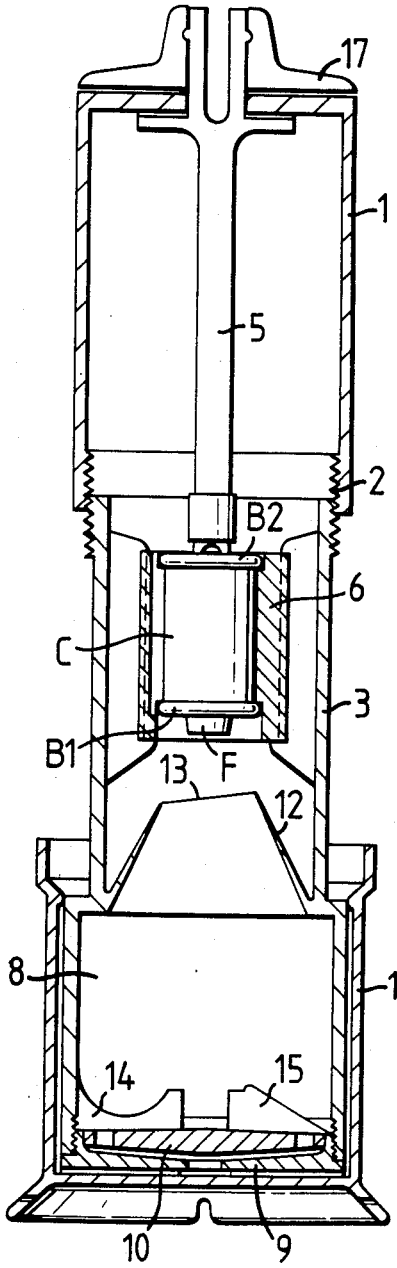
FIG. 2 is a axial-sectional side elevation of a device according to the present invention.
Figure 3:
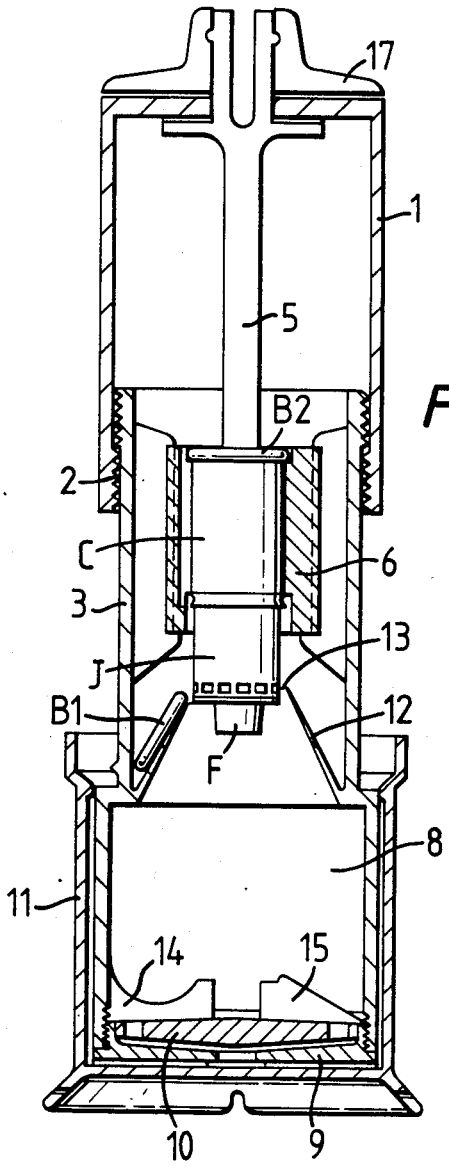
FIG. 3 is a axial-sectional side elevation of the same device as shown in FIG. 2 with the film partially pushed out of the cassette.
Figure 4:
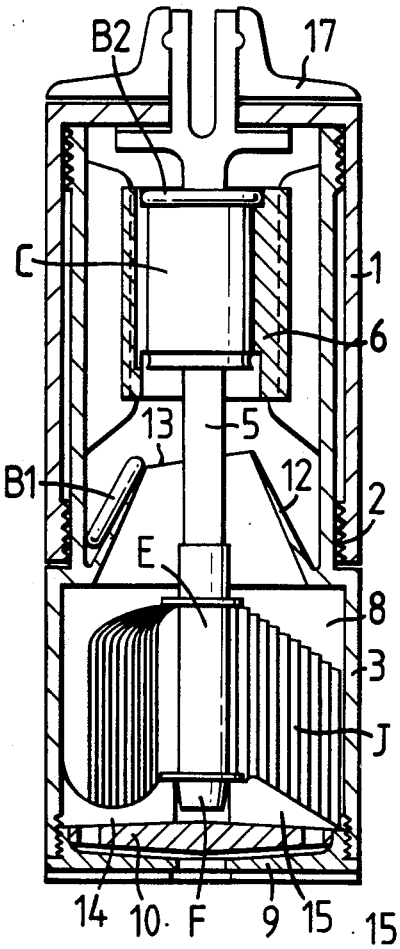
FIG. 4 is a axial-sectional side elevation of the same device as shown in FIGS. 2 and 3 with the film in the processing area.

Thus in FIGS. 2–4 attached to the false base 10 are two thin profile members. Member 14 which is concave in shape serves to bunch the convolutions of the film on the spool together. Member 15 serves to separate the film convolutions.

In FIG. 2 present in the block 6 is a loaded film cassette C having a top end cap B2 and a lower end cap B1.

In FIG. 3 the lid 1 has been screwed further into the columnar body 3. This has caused the plunger to partially force the film J wound onto spool out of the block 6. The end of the film J on spool the long hub and F of which is shown entering the truncated cone 12 through the circular hole 13 in the cone.

The lower end cap B1 is shown retained in the outside of the shelf 12 having been forced off the cassette C.

In FIG. 4 the film J is shown in the processing area 8. The convolutions of the film J have spread out as the coil of film on the spool F has become loosely uncoiled. However, where the coiled film is passed over member 14 the convolutions are bunched, but where the film is passed over member 15 the convolutions are separated.

In operation the lid 1 is screwed off the body 3 and a loaded cassette, with the film fully wound into it, is placed in the block 6. The end of the plunger 5 is fitted over the end of the spool E and the lid 3 then screwed down onto the body. This forces the end cap B1 off the cassette C. In this case the end cap B1 is trapped by the shelf 12 and is prevented from falling into the liquid space 8. As the lid is continued to be screwed down the film J on the spool E is forced out of the cassette C passing throught the hole 13 in the shelf 12 and down into the space 8 and coming to rest so that the end of the spool E is between the two members 14 and 15.

The columnar body 3 with lid 1 attached is then lifted out of the bath 11 and sufficient processing liquid to cover the whole of the film in the space 8 is then placed in the bath 11. The columnar body 3 plus the lid 1 is then carefully placed in the bath 11. The processing liquid is forced into the space 8 through the liquid labyrinth system in the base 9.

The plunger 5 bearing at its end the wound film J on the spool E is caused to rotate by manually rotating the end 17 of the lid 1.

This rotation of the film J in the processing liquid causes the film convolutions continuously to contract and expand as the film is passed over the profile members 14 and 15.

After the requisite processing time the body 3 is lifted out of the bath 11 and the processing liquid flows out of the space 8 into the bath and is usually thrown away. Either another processing liquid is placed in the bath 11 or if a monobath has been used the base 9 is unscrewed from the body 3 and the film J removed from the body 3 for washing.

The lid 1 is then unscrewed from the body 3 and the block 6 is taken out and the cassette body is removed therefrom. The body 3 is the inverted to remove the end cap B1.

Sometimes better processing is obtained if the processing liquid is present in space 8 before the film is pushed into space 8.

Figure 5:
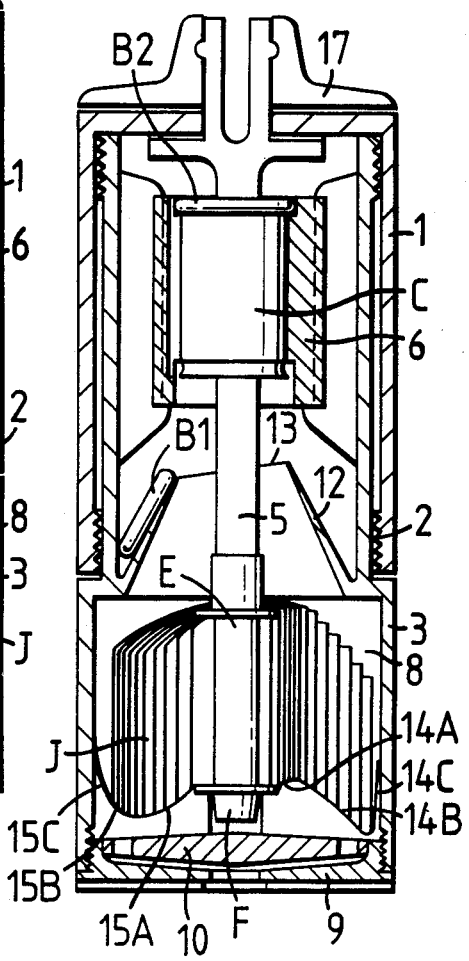
FIG. 5 is a axial-sectional side elevation of similar device to that shown in FIGS. 2–4 but with different shaped raised members.

Turning to the device of FIG. 5 a similar device is shown to that of FIGS. 2–4 and all the numbers have the same specification. However the two thin profile members 14 and 15 are different to those shown in FIGS. 2–4.

Member 14 is a raised member which comprises a step 14A, a sloping portion 14B and a vertical stop member 14C.

Member 15 is a raised member which comprises a sloping portion 15A, and a sudden upwardly caused portion 15B which is combined with a vertical stop member 15C.

In FIG. 5 the film J is shown in the processing area 8. The convolutions of the film J have spread out as the coil of film on the spool F has become loosely uncoiled. However, where the coiled film is passed over part 14A, the convolutions are bunched, but where the film is passed over part 14B the convolutions are separated. Similarly where the coiled film is passed over part 15A the convolutions are separated but where the film is passed over part 15B the convolutions are bunched.

Parts 15C and 14C serve to prevent the leading edge of the film touching the inside wall of the container.

In operation the lid 1 is screwed off the body 3 and a loaded cassette, with the film fully wound into it, is placed in the block 6. The end of the plunger 5 is fitted over the end of the spool E and the lid 3 then screwed down onto the body. This forces the end cap B1 off the cassette C. In this case the end cap B1 is trapped by the shelf 12 and is prevented from falling into the liquid space 8. As the lid is continued to be screwed down the film J on the spool E is forced out of the cassette C passing through the hole 13 in the shelf 12 and down into the container 8 and coming to rest so that the end of the spool F is between the two members 14 and 15.

Sufficient processing liquid to cover the whole of the film in the container 8 is then placed in the bath as shown in FIG. 3. The columnar body plus the lid 1 is then carefully placed in the bath. The processing liquid is forced into the container 8 through the liquid labyrinth system in the base 9.

The plunger 5 bearing at its end the wound film J on the spool E is caused to rotate by manually rotating the end 17 of the lid 1.

This rotation of the film J in the processing liquid first anticlockwise and then clockwise causes the film convolutions continuously to contract and expand as the film is passed over the profile members 14 and 15.

After the requisite processing time the body 3 is lifted out of the bath and the processing liquid flows out of the space 8 into the bath and is usually thrown away. Either another processing liquid is placed in the bath or if a monobath has been used water can then be placed in the bath and the device replaced in the bath. The film is then washed by rotating the film first in one direction and then in another direction. After a predetermined time the water is removed from the device and fresh water placed therein. Good washing is obtained if four or five changes of water are carried out and the total washing time is about 6 minutes. After this period of time the base 9 is unscrewed from the body 3 and the film J removed from body 3 for examination.

FIGS. 6 to 9 show a modified device compared with FIGS. 2–5 in that the device comprises a motor drive and the false base is of rather different construction.

Figure 6:
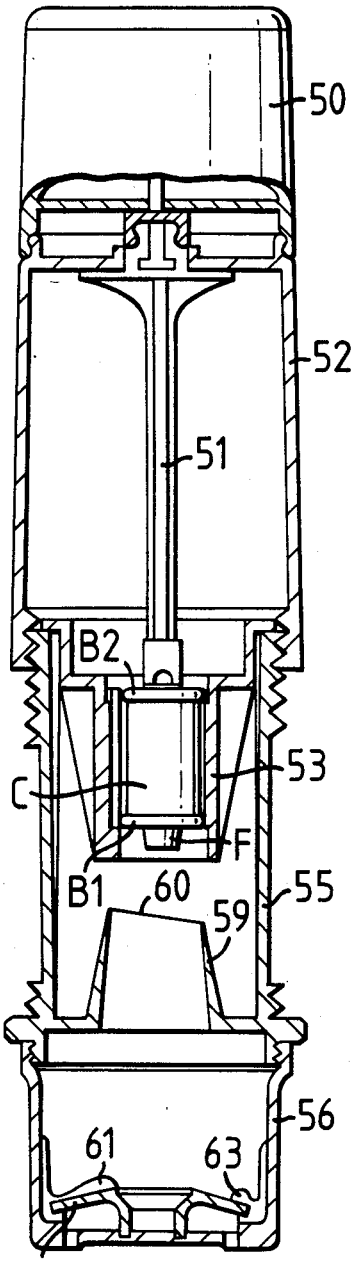
FIGS. 6–8 are a axial-sectional side elevations of a modified device to that shown in FIG. 2–5 showing two of the three different shaped members.
Figure 7:
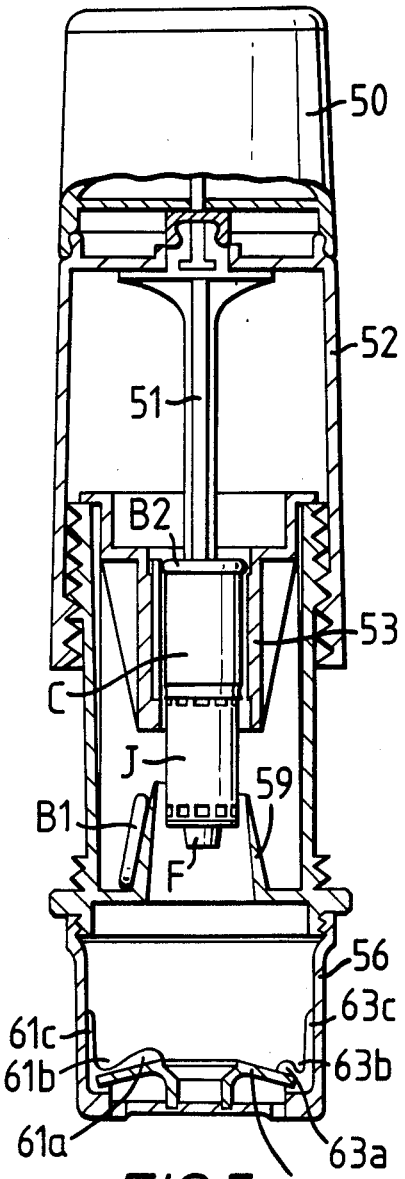
Figure 8:
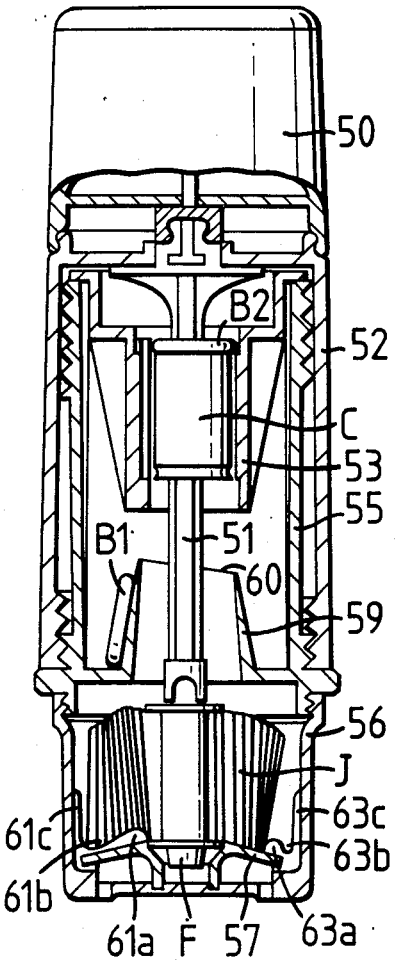

In all the FIGS. 6–8 the same numbers have the same signification.

The drive comprises a motor drive 50 attached to a similar device to that shown in FIGS. 2–5 which comprises a plunger 51 mounted in a lid 52.

A film cassette C is shown located in a block 53 which is held in a columnar body 55.

Attached to the body 55 by screw means is a liquid container 56. At the base of the container 56 is a false base 57. The false base 57 covers a light labyrinth for enabling processing solution to enter the container without the ingress of light Present attached inside of the columnar body 55 and located below the block 53 and above the container 56 is a truncated cone shelf 59 which has in its centre a circular hole 60.

As shown in the FIGS. 6–9 the top of the cone shelf 59 has been formed at an angle.

Figure 9:
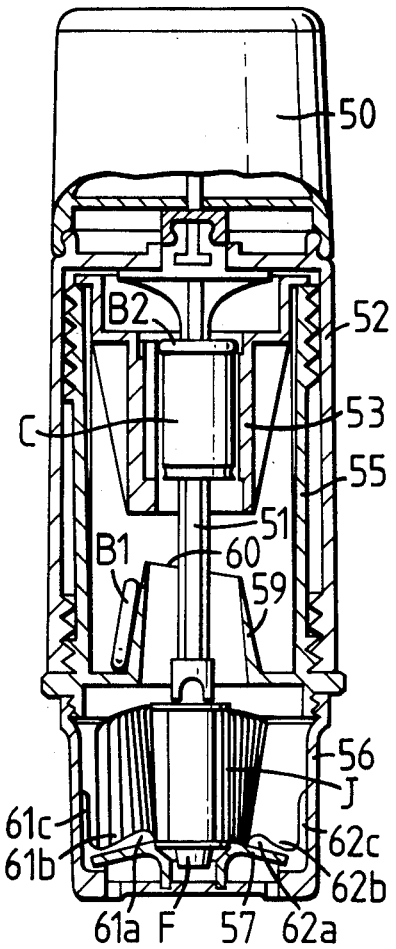
FIG. 9 is a axial-sectional side elevation off the device of FIG. 6 showing the third shaped member as well as one of the members shown in FIG. 6.

Attached to the false base 57 are three thin profile members. Members 61 and 63 are shown in FIGS. 6–9 and member 62 is shown in FIG. 9 which also shows member 61.

These three raised members 61, 62 and 63 are equidistant from each other in a radial array on the surface of the false base 57.

Each of the raised members 61, 62 and 63 comprises a raised shelf or step 61*a*, 62*a* and 63*a*, a sloping area 61*b*, 62*b* and 63*b* and the raised member terminate in a vertical and stop 61*c*, 62*c* and 63*c*. Shelf 61*a* is closest to the centre of the container whilst shelf 63*a* is furthest away from the centre of the container.

In FIG. 6 present in the block 53 is a loaded film cassette C having a top end cap B2 and a lower end cap B1.

In FIG. 7 the lid 52 has been screwed further into the columnar body 55. This has caused the plunger 51 to partially force the film J wound onto spool out of the block 52. The end of the film J on spool the long hub end F of which is shown entering the truncated cone 59 through the circular hole 60 in the cone.

The lower end cap B1 is shown retained in the outside of the cone 59 having been forced off the cassette C.

In FIG. 8 the film J which comprises 36 exposures is shown in the container 56. The convolutions of the film J have spread out as the coil film on the spool F has become loosely uncoiled. However, where the coiled film is passed over member 61 the convolutions are bunched at the inside edge of the raised shelf 61*a* but are separated where they extend to the sloping area 61*b*. The outside coils of the film are bunched where they abut the shelf 63*a* but the inside coils of the film are separated as shown in this figure.

In FIG. 9 a length of film which has 20 exposures in shown being processed. In this case as in FIG. 8 where the coiled film is passed over number 61 at the inside edge of the raised shelf 61*a* the convolutions are bunched but are separated where they extend to the sloping area 61*b*. However the outside coils of the film are bunched where they abut the shelf 62*a* but the inside coils are shown separated.

When a 20 exposure film is being processed the raised member 63 does not really come into play.

On the other hand when a 36 exposure film is being processed raised member 62 acts in a similar manner to member 61 in that the furthest out coils ride over the shelf 62*a* into the sloping area 62*b*.

When the film is in the liquid container as shown in FIGS. 8 and 9 and there is liquid in this container the motor drive 50 initially rotates the film anticlockwise causing all the coils of the film to push out against the vertical end stops 61*c*, 62*c* and 63*c*. Then after a preset period of time the motor drive reverts to clockwise rotation and the position is as shown in FIGS. 8 and 9. Thus some of the coils of the film are bunched and some are separated at any one instance but as the film is rotated the coils which were bunched are separated and the coils which were separated are bunched. This causes the liquid in the container to be pumped into and out of the convolutions thus spreading evenly over the emulsion surface of the film, fresh solution being applied continuously to the emulsion surface.

Figure 10:
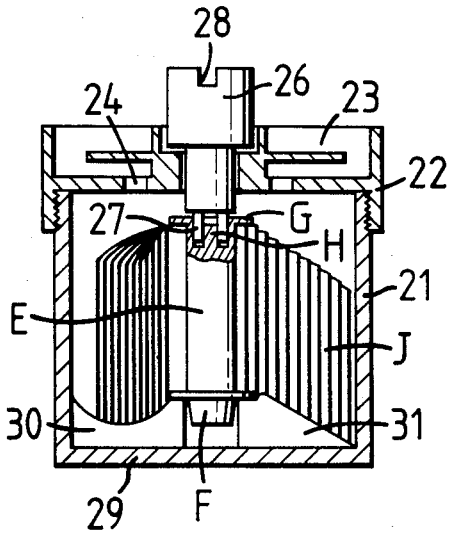
FIG. 10 is a axial-sectional side elevation of a simple device according to the present invention.

The simple device of FIG. 10 comprises a container 21 having a lid 22 which screws down onto the container 21. The lid 22 comprises light-labyrinth 23 covering the liquid channels 24 through which processing liquid can be introduced into the container 21 or removed therefrom by inverting the container.

Mounted in the lid 22 is a knob 26 the lower end 27 of which is forked. The upper end of the knob 26 has a groove 28 therein to which an automatic turning device can be attached.

The forked end 27 of the knob 26 fits over the axial member on the spool E.

Mounted on the base 29 of the device are two profile members 30 and 31.

Member 30 is concave and member 31 slopes away from the centre to the side of the container 21. As described in relation to the same shape profile members in FIGS. 2–4, member 30 serves to bunch the convolutions of the loosely coiled film J and member 31 serves to separate these convolutions.

The long hub F of the spool E is located between profile members 30 and 31.

In operation in the dark the coiled film J on the spool is removed from a cassette. The axial member H in the short hub G of the spool is then fitted into the forked member 27 of the knob 26, the lid 22 having been removed from the container 21. When the spool with the coiled film thereon is firmly fitted on the lid the lid 22 is screwed down on the container 21, care being taken to ensure that the film does not uncoil until the spool has entered the container 21 and that the long hub F is located between members 30 and 31.

The container 21 is then removed from the dark and the requisite amount of processing liquid is introduced into the container via the liquid channels 24. The knob 26 is then rotated continuously first, anticlockwise and then clockwise. This action causes the processing liquid to become automatically pumped into and out of the film convolutions as it is passed over the profile members 30 and 31 and thus fresh processing liquid is constantly caused to flow over the emulsion surface of the film.

When the requisite time for the processing step has elapsed the processing liquid is removed from the container by inverting it and allowing the liquid to flow out of the liquid channels 24. Fresh processing liquid is then introduced into the container via the channels and the knob 26 is then rotated as before.

After all the processing steps have been completed the lid 22 is unscrewed from the container 21 and the coiled film on the spool is taken off the lid and the film water-washed.

If, however, a monobath is used only one processing solution is needed to be added to the continer.

Films processed both in the device of FIGS. 2–9 and in the device of FIG. 10 have been found to have been processed very evenly throughout their length and width.

We claim:

1. A device for processing a roll of exposed film coiled on a spool which comprises a cylindrical light-tight container wherein the film on the spool is rotated and which is of sufficient diameter and height to accommodate the film loosely coiled on the spool, a light-tight lid to close the container, the device being characterised in that it comprises at least two radially extending raised members attached to the base of the container so shaped that as the wound film is rotated in the container some of the convolutions of the film are at one instance bunched together whilst other convolutions are separated and means connectable to the spool for enabling the spool to be rotated when it is in the container.

2. A device according to claim 1, wherein at least one of said radially extending raised members attached to the base of the container is so shaped that the convolutions of the wound film being passed over said at least one member are caused to be bunched together and at least a second one of said radially extending raised members attached to the base of the container is so shaped that the convolutions of the wound film being passed over said second one member are caused to be separated.

3. A device according to claim 2 characterised in that the radially extending raised member which is shaped to bunch together the convolutions of the wound film is concave.

4. A device according to claim 2 characterised in that the radially extending raised member which is shaped to separate the convolutions of the wound film slopes away from the centre to the side of the container.

5. A device according to claim 1, wherein at least one of said radially extending members attached to the base of the container is so shaped that those convolutions of the coiled film being passed over said at least one member which are nearest to the spool are caused to be bunched together and those convolutions which are more remote from the spool are caused to be separated from each other and at least a second one of said radially extending raised members attached to the base of the container is so shaped that those convolutions of the coiled film being passed over said second one member which are nearest to the spool are caused to be separated and those convolutions which are more remote from the spool are caused to be bunched together.

6. A device according to claim 5 characterised in that the radially extending raised member which is shaped to bunch together those convolutions close to the spool and to separate those convolutions more remote from the spool comprises a step over which the film convolutions have to ride as the spool having the film wound thereon rotates and which member slopes away from the highest point of the step towards the inside wall of the container.

7. A device according to claim 5 characterised in that the radially extending raised member which is shaped to separate those convolutions which are nearest the spool and to bunch together those convolutions more remote from the spool is so formed that it initially slopes away from the spool to the inside wall of the container but as it nears the inside wall of the container it is curved sharply upwards.

8. A device according to claim 5 characterised in that the raised members have at their ends closest to the inside wall of the container a vertical end stop of sufficient height to prevent the leading edge of the film as it is rotated on the spool from touching the inside wall of the container.

9. A device according to claim 8 characterised in that there is present on the base of the container a third vertical stop member not attached to a raised member.

10. A device according to claim 1 characterised in that the container comprises on its base three raised members each of which comprises a step and each of which slopes away from the highest point of the step towards the inside wall of the container, the step on each of these raised members being located at a different radial distance from the centre of the container to the other steps.

11. A device according to claim 1 characterised in that the raised members are attached to a false base of the container which acts as a light shielding member over the actual floor of the container which contains holes through which liquid can enter the container and leave the container.

12. A device according to claim 1 characterised in that liquid is introduced into the container via a specially constructed lid, via a specially constructed base or via a pipe formed in the side wall of the container.

13. A device according to claim 1 which is characterised in that it comprises means to receive a cassette loaded with exposed film, the said receiving means being located directly above the container in which the processing is carried out, together with means for forcing the film on the spool out of the cassette and into the container part of the device.

14. A device according to claim 13 characterised in that the film is forced out of the cassette by use of a plunger fitted to the lid of the device.

15. A device according to claim 14 characterised in that the end of the plunger is so designed that it readily engages the end of the spool in the cassette and subsequently retains it by virtue of an interference fit achieved by slight compression of the plunger tip.

16. A device according to claim 14 characterised in that the plunger comprises an internal clutch.

17. A device according to claim 1 which is a device which is required to be loaded in darkness and which is characterised in that there is present in the lid, placed in the centre thereof, a rotatable shaft to which the end of the spool can be engaged in an interference fit and which comprises external means to rotate the shaft.

* * * * *